US005531843A

United States Patent [19]

Stromquist et al.

[11] Patent Number: 5,531,843

[45] Date of Patent: Jul. 2, 1996

[54] EXPLOSIVES USING GLYCOL STILL BOTTOMS

[76] Inventors: Donald M. Stromquist, 33 "C" St., Salt Lake City, Utah 84103; Boyd J. Wathen, 7045 W. 9600 North, Lehi, Utah 84043

[21] Appl. No.: 165,477

[22] Filed: Dec. 13, 1993

[51] Int. Cl.[6] ..... C06B 31/28; C06B 31/30

[52] U.S. Cl. ..... 149/46; 149/21; 149/60; 149/109.2

[58] Field of Search ..... 149/2, 21, 46, 149/60, 109.2

[56] References Cited

U.S. PATENT DOCUMENTS

| | | | |
|---|---|---|---|
| 3,886,008 | 5/1975 | Cook | 149/41 |
| 4,294,633 | 10/1981 | Clay | 149/2 |
| 4,614,146 | 9/1986 | Ross et al. | 86/20.15 |
| 4,685,375 | 8/1987 | Ross et al. | 86/20.15 |
| 4,736,683 | 4/1988 | Bachman et al. | 102/290 |
| 4,746,380 | 5/1988 | Cooper et al. | 149/2 |
| 4,756,779 | 7/1988 | Matts | 149/109.6 |
| 4,780,156 | 10/1988 | Sheeran et al. | 149/21 |
| 4,872,929 | 10/1989 | Mullay | 149/46 |
| 4,889,570 | 12/1989 | Leong | 149/7 |
| 4,933,029 | 6/1990 | Sheeran | 149/7 |
| 5,099,763 | 3/1992 | Coursen et al. | 102/313 |

*Primary Examiner*—Peter A. Nelson
*Attorney, Agent, or Firm*—Mallinckrodt & Mallinckrodt

[57] ABSTRACT

Explosive compositions are disclosed which comprise a nitrate salt oxidizer and glycol still bottoms alone or in combination with water. The still bottoms function as a fuel oil replacement (FOR) in ANFO explosives. Glycol still bottoms can be mixed with thickeners, cross-linkers and other additives to make a bottoms matrix. The bottoms matrix and a nitrate salt oxidizer combine to make explosive compositions which show an improvement in performance and water-resistance when compared to standard ANFO explosives.

17 Claims, No Drawings

EXPLOSIVES USING GLYCOL STILL BOTTOMS

BACKGROUND OF THE INVENTION

1. Field

The invention is in the field of explosives, especially those using nitrate salt oxidizers, and specifically ammonium nitrate-fuel oil explosives (ANFO).

2. State of the Art

Explosives and blasting agents are an important part of the mining industry. It is estimated that over three billion pounds of explosives are used each year in the mining industry in the United States alone. The most commonly used explosive is a mixture of about 94% ammonium nitrate (AN) and about 6% fuel oil (OF), commonly referred to as ANFO. It is sold in the form of dry, loose particles called "prills" generally marketed in bags or in bulk.

Explosive power is measured in terms of weight strength and bulk strength. The term "weight strength", usually expressed in kilocalories per gram, is used to compare explosives which employ nitrate salt oxidizers with ANFO explosives, the standard for the industry. The value of the weight strength for ANFO is frequently assumed to be 1.0 kcal/gm. Bulk strength, a function of the density of the explosive, is used to compare the explosive power of two products on a bulk or volume basis. The higher the volume density, the higher the bulk strength. Its unit of measure is kilocalories per cubic centimeter, abbreviated kcal/cc.

ANFO is relatively inexpensive and widely used, however, its low volume density (about 0.8 gm/cc) limits the amount of useful energy that can be obtained per charge. Efforts to increase the density and therefore the bulk strength of ANFO have included methods using finely ground ammonium nitrate as opposed to nitrate prill particles and the use of high density metallic fuel additives such as aluminum or ferrosilicon.

In addition, ANFO is desensitized by water, precluding its use in water-filled boreholes. In efforts to provide a waterproof ANFO, many water-in-oil and oil-in-water emulsion products have been described in numerous patents. Attempts have also been made to waterproof ANFO by using thickeners and cross-linkers; for example, Sheeran, U.S. Pat. No. 4,933,029 and Stromquist and Wathen, U.S. Pat. No. 4,693,763.

Not only have there been numerous attempts to increase the explosive power and waterproof properties of ANFO explosives, other attempts have been made to provide for easier handling, transporting and loading of the product. These efforts have met with limited success.

There remains a need in the industry for inexpensive, easily manufactured explosives having equal or increased explosive power when compared to ANFO which are easily and safely transported, stored, and loaded; are water-resistant; and which have negligible impact on the environment.

SUMMARY OF THE INVENTION

The invention encompasses explosive compositions comprising a mixture of at least one nitrate salt oxidizer and glycol still bottoms used alone or diluted with water. Alternatively, the glycol still bottoms can be mixed with other additives such as thickeners, cross-linkers and pH adjusters to form a matrix composition, herein termed "bottoms matrix". This matrix composition can then be mixed with at least one nitrate salt oxidizer to form an explosive composition.

Glycol still bottoms, abbreviated to "still bottoms" or "bottoms" herein, have been found to be a suitable replacement for the commonly used fuel oils in ANFO explosives. Therefore, still bottoms plus water or a bottoms matrix are also herein referred to as "FOR" for "fuel oil replacement". The explosives which use a combination of ammonium nitrate (AN) and FOR are herein called "FOR-AN" explosives.

DETAILED DESCRIPTION OF THE PREFERRED EMBODIMENT

Glycol still bottoms are the waste-product remaining in distillation units during the process for making marketable glycol products. Primary glycol producers extract ethylene glycol, diethylene glycol, triethylene glycol, and other lower glycols from a mixed glycol starting material. The remaining by-product in the distillation unit after extraction of the lower glycols is used by secondary producers to extract additional lower glycols. The material remaining in distillation units after extraction of the additional lower glycols is a still more concentrated form of a waste product termed glycol still bottoms. Still bottoms comprise a mixture of lower and higher glycols, polyglycols, glycol-ethers as well as various derivatives.

The glycol still bottoms have a high pH value and cannot be used as taken directly from distillation units due to the inherent hazards encountered when handling materials of high pH value. Neutralization of the still bottoms with HCl lends the bottoms non-hazardous and non-flammable.

The principal use of glycol still bottoms has been in the coal industry for de-icing. The glycol-rich bottoms prevent individual coal lumps from freezing together during inclement weather, thus avoiding handling problems. This use is limited, however, and at times the disposal of still bottoms has become problematic, often forcing producers to pay for removal.

The glycol still bottoms cannot be used as taken directly from distillation units due to the inherent hazards encountered when handling materials of high pH value. Neutralization of the still bottoms with HCl lends the bottoms non-hazardous and non-flammable.

We have discovered that glycol still bottoms may be used in place of fuel oil to make a nitrate salt explosive. For example, the glycol still bottoms may be used as a replacement for the fuel oil normally mixed with ammonium nitrate to produce an ANFO explosive.

Glycol still bottoms as removed from distillation units, even after neutralization, may still be too viscous for efficient use in the present invention. When thinned with water up to about 35%, the advantageous properties of the bottoms in the manufacture of explosive compositions equal or exceed those of diesel fuel or mineral oil.

In addition to blending well with water, it has been found that still bottoms blend well with nitrate salt oxidizers. It appears that still bottoms are superior when compared to fuel oil in the penetration of ammonium nitrate prill particles. Substantiation by microscopic examination shows efficient filling of the capillaries and interstices of the prill particle. The observed increased density of FOR-AN explosives compared to ANFO explosives supports a finding of increased penetration of prills by the still bottoms.

Still bottoms have a freeze point far below temperatures encountered in mining and quarrying in the United States and Canada and a flash point far above that of fuel oil or mineral oil. The bottoms can easily be pumped and handled, have no known health hazard, and are not regulated in shipment or storage. Also, unlike fuel oil and mineral oil, there is no measurable evaporation of the still bottoms, even when mixed with up to 35% water, under normal storage conditions.

A typical analysis of glycol still bottoms is found in Table I. A typical specification for the bottoms is found in Table II. It is anticipated that each batch of glycol still bottoms will have similar characteristics, although analysis and specification data may vary according to content and concentration of the glycols and glycol-ethers which are present. These variations are dependent upon content of the starting material and the operating conditions of processing. However, these variations do not appear to affect the ability of the bottoms to function as a fuel oil replacement.

TABLE I

TYPICAL ANALYSIS OF GLYCOL STILL BOTTOMS

| COMPOSITION | ANALYSIS DRY BASIS % |
|---|---|
| DILETHYLENE GLYCOL (DEG) | 3.71 |
| DEG BUTYL ETHER | 2.41 |
| TRIETHYLENE GLYCOL (TEG) | 22.68 |
| TEG ETHYL ETHER | 3.43 |
| TETRA ETHYLENE (EG) GLYCOL | 26.66 |
| TETRA EG ETHYL ETHER | 2.08 |
| TETRA EG BUTYL ETHER | 1.62 |
| PENTA EG | 13.03 |
| PENTA EG ETHYL ETHER | 2.85 |
| PENTA EG HEXYL ETHER | 1.08 |
| PENTA EG BUTYL ETHER | 6.25 |
| HEXA EG | 2.50 |
| HEXA EG BUTYL ETHER | 6.5 |
| HEPTA EG BUTYL ETHER | 4.34 |
| OCTA EG BUTYL ETHER | 0.8 |

Typical water analysis equals about 10% after neutralization with HCl to bring pH values to about 6.5–7.5

TABLE II

TYPICAL SPECIFICATION OF GLYCOL STILL BOTTOMS*

| | |
|---|---|
| GLYCOLS AND DERIVATIVES | <95.0% |
| NON-EVAPORATIVE SOLIDS AT 165° C. | <16.0% |
| INORGANIC ASH | 8.5% |
| WATER | <10.0% |
| VISCOSITY AT 0° F. | 6400 CPS |
| VISCOSITY OF 50% WATER SOLUTION AT 0° F. | 105 CPS |
| SPECIFIC GRAVITY | 1.16 |
| DENSITY | 9.67 lbs/gal |
| pH (AFTER NEUTRALIZATION WITH HCl) | 6.5–7.5 |

*KMCO, INC., Houston, Texas

Water can be added to the still bottoms to adjust viscosity before mixing the bottoms with nitrate salt oxidizers. Water can also be added after the bottoms and oxidizer have been mixed. Further, a matrix can be made of bottoms plus water plus other additives and the matrix can then be mixed with nitrate salt oxidizers. In some cases, water can be a solute for nitrate salt oxidizers to become a part of a bottoms matrix.

Commonly used nitrate salt oxidizers of the invention are ammonium nitrate, sodium nitrate, calcium nitrate, magnesium nitrate, and combinations of these. Ammonium nitrate is the preferred oxidizer and may be present in the explosive in amounts from about 50% to 98%, more preferably from about 85% to 96%, by explosive weight. Up to about 50% of the ammonium nitrate can be replaced with other nitrate salt oxidizers.

To render the explosives of the invention water-resistant, thickeners, optionally cross-linking thickeners, are added to the still bottoms to form a bottoms matrix. Rather than a cross-linking thickener, thickeners and cross-linking agents can be separately added to the bottoms to accomplish the same purpose. Commonly used thickeners of the invention are cold water swellable and able to produce high viscosities within a matter of hours, for example, guar gums, gum arabic, starches, xanthan gums, polyacrylamide, cellulose and cellulose derivatives. Guar gums are presently preferred.

Commercially available cross-linking or non-cross-linking guar gums may be used in the amount of from about 0.2% to 1.5%, more preferably, from about 0.2% to 0.8%. For example, No. 2379 guar gum sold by Rhone-Poulenc, Louisville, Ky., contains the cross-linker potassium pyroantimonate. Alternatively, a non-cross-linking guar gum may be used and cross-linking can be accomplished with the addition to the bottoms matrix of about 1.0–1.5% based on guar gum concentration. Preferable cross-linkers include antimonates, especially potassium antimony tartrate; dichromates; borates, especially sodium tetraborate; tannic acids; and other selected organic acids, among others. The antimonates, especially the pyroantimonates are most preferable.

Other additives to the still bottoms to create a bottoms matrix may include weak acids for pH adjustment. For example, when using gum thickeners with or without cross-linkers, adjustment of the matrix mixture with glacial acetic acid to a final pH of 5.5– 6.5 provides for successful completion of chemical reactions.

The following examples compare FOR-AN explosives of the invention to the standard results obtained with ANFO explosives. Characteristics of ANFO explosives are commonly known in the industry. The examples demonstrate performance of the invention under both unconfined above-ground conditions and dry mine field conditions.

EXAMPLE 1

The first propagated above-ground unconfined test shootings of the FOR-AN explosives of the invention employed a formulation compounded from glycol still bottoms and ammonium nitrate prills.

The mixture for explosive Charge 1 of this example was hand-mixed using conventional bench-top techniques. Glycol still bottoms purchased from KMCO, Inc., containing about 10–12% $H_2O$ at pH 6.5–7.5, were mixed with additional water to give the still bottoms a 19% water content. The bottoms were then mixed with ammonium nitrate prills in the proportions given in Table III.

Explosive Charge 2 was made of a charge mixture of a still bottoms matrix and ammonium nitrate prills. The matrix itself was made of a mixture of water and ammonium nitrate added to still bottoms. The proportions for the matrix and the charge mixture are given in Table III.

One thousand grams of the charge mixtures as described above were packed into cardboard cylinders, measuring 3 and 4 inches in diameter and 10 inches in length to give a density of 1 gm/cc. One hundred twenty grams of pentolite equivalent primer was packed into the top end of the cylinders. The results of this example were that all charges detonated, showing similar sensitivity and bulk strength as commonly expected using ANFO explosives.

In this Example and in Examples 2 through 4 describing the unconfined tests, the term "detonation" means that the main charge, when primed and initiated, tripped or detonated a 25 grain detonating cord embedded in the charge at the cylinder end opposite the primer initiation end In the field tests, "detonation" was measured as a visually estimated disturbance or fragmentation in the earth or rock surrounding the charges. In underwater tests, "detonation" was measured with instruments.

The ammonium nitrate prills in this and the following examples were obtained from either LaRoche Chemicals, Geneva, Utah or Wycon Chemicals, Cheyenne, Wyo. Other sources of ammonium nitrate prills which have been successfully used with glycol still bottoms to make the explosive compositions of the invention have been supplied by ICI Chemical Company, Calgary, Alberta, Canada; IRECO, Donora, Pa.; ETI Chemicals, Seneca, Ill.; and Nitrochem, Ontario, Canada.

As indicated above, the glycol bottoms used in the Examples were obtained from KMCO, Inc., Houston, Tex.

TABLE III

| EXPLOSIVE CHARGE FORMULATIONS | |
|---|---|
| CHARGE 1 Mixture (% explosive weight) | |
| Still Bottoms (19% $H_2O$) | 13% |
| Ammonium Nitrate Prills | 87% |
| CHARGE 2 Mixture (% explosive weight) | |
| Bottoms Matrix | 15% |
| Ammonium Nitrate | 85% |
| Bottoms Matrix (% matrix weight) | |
| Still Bottoms (19% $H_2O$) | 65% |
| Ammonium Nitrate Prills | 30% |
| $H_2O$ | 5% |

EXAMPLE 2

Materials and methods were essentially the same as described in Example 1. The formulation of the explosives consisted of 8% still bottoms (19% $H_2O$) and 92% of ammonium nitrate prills.

One thousand grams of the explosive was packed into cardboard cylinders measuring 3 inches, 3.5 inches and 4 inches in diameter and 12 inches in length. One hundred twenty grams of pentolite equivalent primer was used. All charges detonated showing similar sensitivity and bulk strength as commonly exhibited by ANFO explosives.

EXAMPLE 3

Other repetitive unconfined tests were performed using mixtures of still bottoms and ammonium nitrate prills in which the water content of the still bottoms was varied to account for up to 35% of the bottoms (up to about 3.5% of the explosive). Materials and methods for making the charges were essentially the same as in Charge 1 of Example 1. Formulations for high-water content charges are found in Table IV. These tests showed results similar to the results from the Examples 1 and 2 test detonations. Detonations occurred in each case.

The unexpected results of the tests of this Example are that the FOR-AN explosives did detonate. ANFO explosives containing this amount of water would not be predicted to detonate. Water present in the FOR-AN explosive charges in amounts of 2.4% to 3.5% gave no evidence of deterrence of energy production. In contrast, it is commonly known that water acts as an energy deterrent when present in ANFO explosives in amounts over 1.0% to 1.5%.

TABLE IV

| EXPLOSIVE CHARGE FORMULATIONS | |
|---|---|
| Charge 1 mixture | |
| Still Bottoms (30% $H_2O$) | 8% |
| Ammonium Nitrate Prills | 92% |
| Charge 2 Mixture | |
| Still Bottoms (35% $H_2O$) | 8% |
| Ammonium Nitrate Prills | 92% |

EXAMPLE 4

Further repetitive unconfined tests were completed using the explosive charges of the formulations illustrated in Table V.

To make the bottoms matrix for Charges 1 and 2, a small amount of still bottoms (10% $H_2O$) was mixed with water and then with the gum. The remainder of the still bottoms and water were added to the mixture.

To make the bottoms matrix for Charge 3, a mixture of water and calcium nitrate was added to the still bottoms. Then a small amount of this mixture was added to the gum. After the gum was absorbed, the remainder of the still bottoms, water, and calcium nitrate mixture was added.

The resulting bottoms matrix mixtures in each case were adjusted to a pH of 5.5 with glacial acetic acid and then added to the ammonium nitrate prills in the proportions given in Table V.

The charge mixtures not only exhibited a viscous consistency and appearance, water resistance was apparent, especially in charge mixture 2. The No. 2379 gum contained a cross-linker, potassium pyroantimonate, which assisted in forming a more viscous bottoms matrix.

The charge mixtures weighing about 762 grams each were loaded into cylinders measuring three to five inches in diameter and ten inches in length. One hundred twenty-five grams of pentolite equivalent primer was used to detonate the charges. Visually superior results were obtained using the FOR-AN explosives as compared to commonly known results using ANFO explosives.

TABLE V

| EXPLOSIVE CHARGE FORMULATIONS | |
|---|---|
| Charge 1 Mixture (% explosive weight) | |
| Bottoms Matrix | 15.0% |
| Ammonium Nitrate Prills | 85.0% |
| Bottoms Matrix (% matrix weight) | |
| $H_2O$ | 34.0% |
| No. 8000 guar gum* | 0.5% |
| Glacial acetic acid | 0.5% |
| Still Bottoms (19% $H_2O$) | 65.0% |
| Density = 1.01 gm/cc | |
| Charge 2 Mixture (% explosive weight) | |
| Bottoms Matrix | 17.0% |
| Ammonium Nitrate Prills | 83.0% |
| Bottoms Matrix (% matrix weight) | |
| Calcium nitrate | 30.0% |
| $H_2O$ | 31.0% |

TABLE V-continued

| EXPLOSIVE CHARGE FORMULATIONS | |
|---|---|
| No. 2379 guar gum** | 0.6% |
| Glacial acetic acid | 0.4% |
| Still Bottoms (19% $H_2O$) | 38.0% |
| Density = 1.13 gm/cc | |
| Charge 3 Mixture (% explosive weight) | |
| Bottoms Matrix | 15.0% |
| Ammonium Nitrate Prills | 85.0% |
| Bottoms Matrix (% matrix weight) | |
| $H_2O$ | 32.0% |
| Calcium nitrate | 20.0% |
| No. 8000 guar gum | 0.5% |
| Glacial acetic acid | 0.5% |
| Still Bottoms (19% $H_2O$) | 47.0% |
| Density = 1.10 gm/cc | |

*Rhone-Poulenc, Louisville, Kentucky
**Contains cross-linking agent, potassium pyroantimonate

EXAMPLE 5

A field test was conducted in a West Virginia coal mine. Using a backhoe, charge material was mixed in the bucket and loaded into nine inch diameter bore holes which were nineteen to twenty feet deep and arranged in a twenty-five foot by twenty-five foot pattern. The charge material consisted of 8% still bottoms (19% $H_2O$) and 92% ammonium nitrate prills. FOR-AN explosives were compared to Heavy ANFO explosives (HANFO), which are explosives made from an emulsion of oil-in-water plus ammonium nitrate. FOR-AN charges contained 20% less weight of explosive in each hole than did the HANFO charges, i.e., typically 320 lbs. of charge material were placed into the HANFO holes compared to 260 lbs. in the FOR-AN holes. The density of the FOR-AN explosive was 0.95–0.97 gm/cc. The density of the HANFO explosive was about 1.2 gm/cc. All charges detonated. After shooting, fragmentation was visually compared. No apparent differences were observed between the results of the FOR-AN detonations and the results of the HANFO detonations.

EXAMPLE 6

Field tests were performed in Pennsylvania in order to compare the explosive strength of FOR-AN explosives to ANFO explosives.

ANFO and FOR-AN explosives were prepared using the methods of Example 5. ANFO explosive mixtures consisting of 6% mineral oil and 94% ammonium nitrate prills were packed to give a density of 0.83 gm/cc. FOR-AN explosive mixtures of the formulation in Table VI were packed to give a density of 0.96 gm/cc. Holes were dug to be about 6 inches in diameter and 43 feet deep, arranged in a pattern of a 16 foot spacing by a 16 foot burden. Approximately one-half of the holes were filled with about 330 lbs. each of ANFO explosives and the other half with 311 lbs. each of FOR-AN explosives.

After shooting, damage fragmentation was visually compared. No apparent differences were observed between the results of the FOR-AN detonations and the results of the ANFO detonations.

TABLE VI

| EXPLOSIVE CHARGE FORMULATION | |
|---|---|
| Charge Mixture (% explosive weight) | |
| Bottoms Matrix | 15.0% |
| Ammonium Nitrate Prills | 85.0% |
| Bottoms Matrix (% matrix weight) | |
| $H_2O$ | 35.0% |
| No. 8000 guar gum | 0.4% |
| No. 2379 guar gum | 0.4% |
| Glacial acetic acid | 0.2% |
| Still Bottoms (25% $H_2O$) | 64.0% |
| Density averaged 1.05 to 1.08 gm/cc. | |

The observations and conclusions drawn from Examples 1 through 6 indicate the following: 1. The FOR-AN explosive compositions of this invention show an increase in density when compared to ANFO explosive compositions. It follows that a corresponding increase in weight and bulk strength will be observed for FOR-AN explosives when compared to ANFO explosives of the same weight. 2. Increased water-resistance is demonstrated for FOR-AN explosives when compared to standard ANFO explosives. 3. Penetration of individual prill particles of AN by the glycol still bottoms in FOR-AN explosives is superior to fuel oil or mineral oil penetration of AN in ANFO explosives. This is suggested to be a major factor in benefits in performance demonstrated in comparative tests.

The invention has been described using glycol still bottoms as a waste product in distillation units after extraction of lower glycols from a mixed glycol starting material. The use of such waste material is presently preferred because of its status as a waste material, its availability and resulting low cost. It should be realized that the still bottoms as defined herein could be specifically manufactured for use in the invention rather than merely collected as a waste product. When specifically manufactured, the still bottoms mixture can include, in addition to water up to about 35%, any one or more of the glycols listed in Table 1.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An explosive composition comprising at least one nitrate salt oxidizer and glycol still bottoms.

2. An explosive composition comprising at least one nitrate salt oxidizer, glycol still bottoms, and additional water.

3. A bottoms matrix composition to be added to at least one nitrate salt oxidizer to produce an explosive composition, comprising glycol still bottoms, additional water, and thickeners.

4. An explosive composition comprising at least one nitrate salt oxidizer and a bottoms matrix composition which includes glycol still bottoms.

5. A composition according to claim 1, 2, 3, or 4, wherein the glycol still bottoms comprise glycols with from 2 to about 40 carbon atoms with and without ether linkages.

6. A composition according to claim 1, 2, 3, or 4, wherein the glycol still bottoms comprise water and at least one component selected from a group consisting of diethylene glycol, diethylene glycol butyl ether, triethylene glycol, triethylene glycol ethyl ether, tetra ethylene glycol, tetra ethylene glycol ethyl ether, tetra ethylene glycol butyl ether, penta ethylene glycol, penta ethylene glycol ethyl ether, penta ethylene glycol hexyl ether, penta ethylene glycol butyl ether, hexa ethylene glycol, hexa ethylene glycol butyl ether, hepta ethylene glycol, hepta ethylene glycol ethyl ether, hepta ethylene glycol butyl ether, octa ethylene glycol ethyl ether, octa ethylene glycol butyl ether, and combinations thereof.

7. An explosive composition according to claim 1, 2 or 4, wherein the nitrate salt oxidizer is selected from a group consisting of ammonium nitrate, calcium nitrate, sodium nitrate, magnesium nitrate, and combinations thereof.

8. An explosive composition according to claim 1, 2 or 4, wherein the nitrate salt oxidizer comprises between about 50% and about 96% of the explosive composition.

9. An explosive composition according to claim 1, 2, or 4, wherein the nitrate salt oxidizer comprises between about 80% and about 95% of the composition.

10. A composition according to claim 2 or 3, wherein the additional water comprises between about 8% and about 35% of the glycol still bottoms.

11. A composition according to claim 2 or 3, wherein the additional water comprises between about 18% and about 35% of the glycol still bottoms.

12. A composition according to claim 3, wherein the thickener is selected from the group consisting of guar gums, gums arabic, starches, xanthan gums, polyacrylamides, celluloses and cellulose derivatives and combinations thereof.

13. A composition according to claim 3, wherein the thickener comprises a guar gum.

14. A composition according to claim 13, wherein the guar gum contains a cross-linking compound.

15. A composition according to claim 3, further comprising a cross-linking compound.

16. A composition according to claim 14 or 15, wherein the cross-linking compound is selected from a group consisting of borates, dichromates, antimonates and combinations thereof.

17. A composition according to claim 3, further comprising a pH adjuster.

* * * * *